US009299548B2

(12) United States Patent
Bonner et al.

(10) Patent No.: US 9,299,548 B2
(45) Date of Patent: Mar. 29, 2016

(54) METHOD FOR MASS SPECTROMETRY

(71) Applicant: DH TECHNOLOGIES DEVELOPMENT PTE. LTD., Singapore (SG)

(72) Inventors: Ronald Bonner, Newmarket (CA); Yves Le Blanc, Newmarket (CA); Stephen Alexander Tate, Barrie (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 14/353,762

(22) PCT Filed: Oct. 26, 2012

(86) PCT No.: PCT/IB2012/002154

§ 371 (c)(1),
(2) Date: Apr. 23, 2014

(87) PCT Pub. No.: WO2013/061142

PCT Pub. Date: May 2, 2013

(65) Prior Publication Data

US 2015/0034815 A1 Feb. 5, 2015

Related U.S. Application Data

(60) Provisional application No. 61/551,593, filed on Oct. 26, 2011.

(51) Int. Cl.
*H01J 49/00* (2006.01)

(52) U.S. Cl.
CPC ..... *H01J 49/0045* (2013.01); *H01J 49/004* (2013.01); *H01J 49/0027* (2013.01); *H01J 49/0031* (2013.01)

(58) Field of Classification Search
USPC ..... 250/281, 282, 283
See application file for complete search history.

(56) References Cited

U.S. PATENT DOCUMENTS

| | | | | |
|---|---|---|---|---|
| 2010/0084547 | A1* | 4/2010 | Pringle et al. | 250/282 |
| 2010/0282957 | A1 | 11/2010 | Wouters et al. | |
| 2010/0288917 | A1 | 11/2010 | Satulovsky et al. | |
| 2010/0301205 | A1 | 12/2010 | Thomson | |
| 2011/0204218 | A1 | 8/2011 | Hager et al. | |

FOREIGN PATENT DOCUMENTS

WO 0077824 A1 12/2000

OTHER PUBLICATIONS

International Search Report for PCT/IB2012/002154, mailed Feb. 25, 2013.
Written Opinion for PCT/IB2012/002154, mailed Feb. 25, 2013.
International Preliminary Report on Patentability for PCT/IB2012/002154, mailed Apr. 29, 2014.

* cited by examiner

*Primary Examiner* — Nicole Ippolito

(57) ABSTRACT

A method is provided for mass spectrometry. The method includes generating precursor ions from a sample; transmitting the precursor ions into a collision cell; generating product ions in the collision cell; detecting the precursor and product ions; applying modulation to one or more of the precursor ion intensity and the product ion intensity; and identifying precursor ion and product ion relationships by analyzing intensity profiles defined by the modulation.

10 Claims, 4 Drawing Sheets

METHOD FOR MASS SPECTROMETRY

RELATED APPLICATION

This application claims priority to U.S. provisional application No. 61/551,593 filed Oct. 26, 2011, which is incorporated herein by reference in its entirety.

FIELD

The applicant's teachings relate to a method of mass spectrometry.

INTRODUCTION

Identification of compounds by mass spectrometry often involves generating a molecular (precursor) ion for the compound of interest, fragmenting the precursor to generate product ions (fragments), and relating these to substructures of the molecule. In addition to analyzing the product ions generated from a particular precursor it can be useful to further fragment those product ions to generate second generation products since this can help distinguish different substructures that have the same mass. However, this requires additional time since the precursor ion must be fragmented, a product ion selected and fragmented, and the resulting second generation fragments mass analyzed. Furthermore, only certain types of mass spectrometer are capable of performing this type of analysis (known as $MS^3$).

In addition, mass spectrometry is poor at analyzing complex mixtures since it may not be possible to correctly associate related ions (molecular, isotopes, adducts, and/or product ions) unless the molecules or precursor ions are filtered prior to fragmentation. This filtering can simplify the interpretation but will also increase the time required to analyze all species present. One way to overcome this is to use alternate separation techniques (LCMS, GCMS, CEMS) to reduce the complexity of the mixture, but these techniques may not have sufficient separation capability to allow single component analysis at any given elution point. Many techniques have been developed to automatically select the precursor ions and perform MS/MS in 'real-time', but this typically limits the analysis of other species eluting over a short period of time. An alternate solution is to fragment all ionized species at once and simultaneously detect all product ions, but the ability to associate fragment and precursor ions is lost and so is structural/sequence information.

Fundamentally, these separation techniques modulate the amount of material reaching the instrument so that the signal from related ions has the same modulation. Separating the ions into groups that have the same modulation can be used to associate related members. Chromatographic separation techniques, such as LCMS and GCMS, are not the only way to modulate the signal and other approaches may have advantages. For example, separating compounds chromatographically requires time, especially in complex samples, which limits the sample throughput. Furthermore, some compounds are typically not retained by the chromatographic system and elute together and are unresolved while others can be permanently retained by the system.

Thus, there is a need for techniques that provide ways to generate first or later generation fragments that can be associated with their precursor ions so that complex samples can be analyzed with high throughput and with as high a compound coverage as possible. Chromatography may still be involved, but the separation achieved and the time required could be reduced.

SUMMARY

In accordance with an aspect of the applicant's teachings, a method of mass spectrometry is provided. In various embodiments, the method can comprise generating precursor ions from a sample; transmitting the precursor ions into a collision cell; generating product ions in the collision cell; detecting the precursor and product ions; applying modulation to one or more of the precursor ion intensity and the product ion intensity; and identifying precursor ion and product ion relationships by analyzing intensity profiles defined by the modulation.

In various embodiments, the related precursor and product ions are determined by identifying ions that are correlated. In various aspects, the modulation applied comprises varying a parameter upstream of the collision cell such that the precursor ion intensity varies in a compound dependent manner. In various embodiments, the parameter comprises declustering potential. In various embodiments, the parameter comprises a voltage applied to a differential ion mobility cell. In various aspects, the voltage comprises one or more of a compensation voltage and a separation voltage.

In various embodiments, the related precursor ion and product ions are determined by identifying ions that are anti-correlated. In various aspects, the modulating comprises varying the collision energy according to a specified pattern repeated over a continuous series of acquisition cycles. In various embodiments, the modulation comprises varying the absolute collision energy (CE) values with an equal amount of time spent at each discrete CE value.

In various embodiments, the related product ions and later generation product ions are anti-correlated. In various aspects, the modulation comprises varying the collision energy across a range of values.

These and other features of the applicants' teachings are set forth herein.

BRIEF DESCRIPTION OF THE DRAWINGS

The skilled person in the art will understand that the drawings, described below, are for illustration purposes only. The drawings are not intended to limit the scope of the applicants' teachings in anyway.

In the drawings, like reference numerals indicate like parts.

DESCRIPTION OF VARIOUS EMBODIMENTS

It should be understood that the phrase "a" or "an" used in conjunction with the applicants' teachings with reference to various elements encompasses "one or more" or "at least one" unless the context clearly indicates otherwise.

In various embodiments, a method is provided for mass spectrometry. In various aspects, the method can comprise generating precursor ions from a sample; transmitting the precursor ions into a collision cell; generating product ions in the collision cell; detecting the precursor and product ions; applying modulation to one or more of the precursor ion intensity and the product ion intensity; and identifying precursor ion and product ion relationships by analyzing intensity profiles defined by the modulation.

In various embodiments, the related precursor ion and product ions can be determined by identifying ions that are correlated. In various aspects, the modulation applied comprises varying a parameter upstream of the collision cell such that the precursor ion intensity varies in a compound dependent manner. In various embodiments, the parameter can comprise declustering potential or a parameter that controls the degree of ionization, such as ionspray voltage. In various embodiments, the parameter comprises a voltage applied to a differential ion mobility cell. In various aspects, the voltage comprises one or more of a compensation voltage and a separation voltage.

Figure 1:
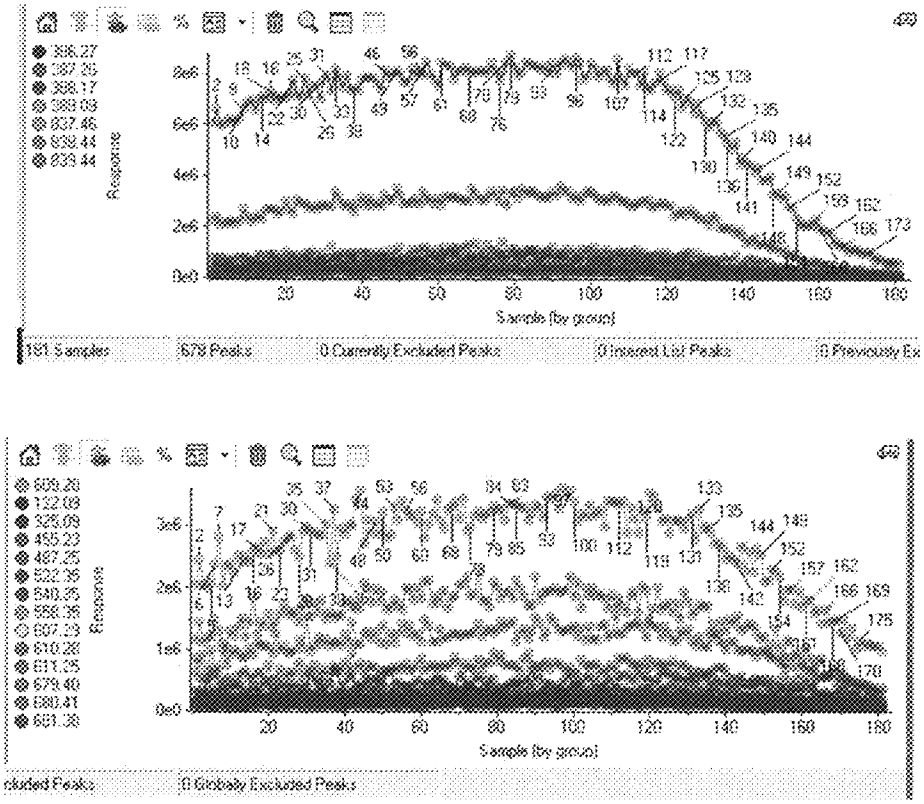
FIG. 1 shows varying the declustering potential and two resulting correlated groups of signal according to various embodiments of the applicant's teachings.

FIG. 1 shows varying the declustering potential and two resulting correlated groups of signal according to various embodiments of the applicant's teachings.

In various embodiments, the related precursor ion and product ions are determined by identifying ions that are anti-correlated. In various embodiments, each scan generated by the instrument is a composite MSMS spectrum obtained at two or more collision energies (CE). In various aspects, the modulation comprises varying the collision energy according to a specified pattern repeated over a continuous series of acquisition cycles. In various embodiments, the modulation comprises varying the absolute collision energy (CE) values with an equal amount of time spent at each discrete CE value. In various embodiments, two discrete CE values can be used and the fraction of time spent at each CE value can be modified. In either case, a resulting modulated signal associated with the precursor ion as well as product ions will be generated.

Figure 2:
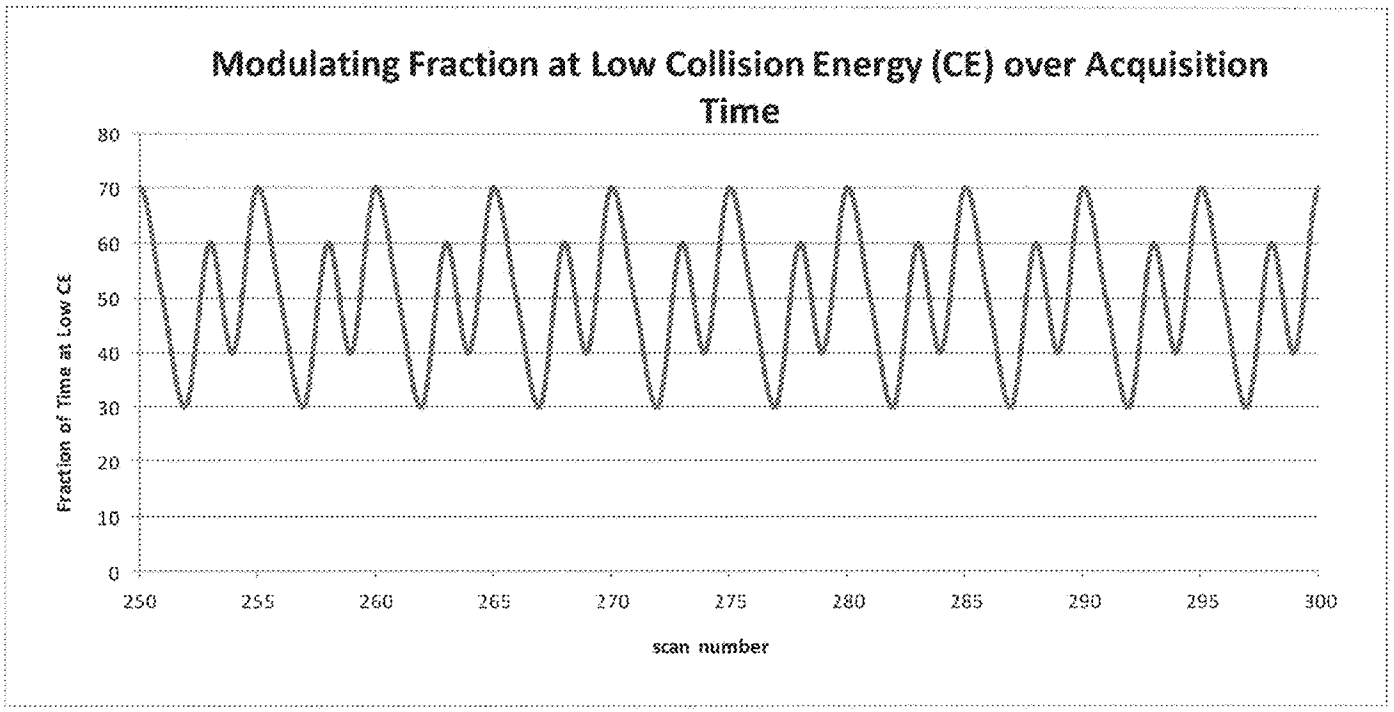
FIG. 2 shows the modulation of the amount of time spend recording the low collision energy spectrum over time according to various embodiments of the applicant's teachings.

FIG. 2 shows the modulation of the amount of time spend recording the low collision energy spectrum over time. Here, a cycle of 4 independent ratios of accumulation time was used, thus generating a pattern of intensity unique to the ion (in this case the precursor) as a function of time.

Figure 3:
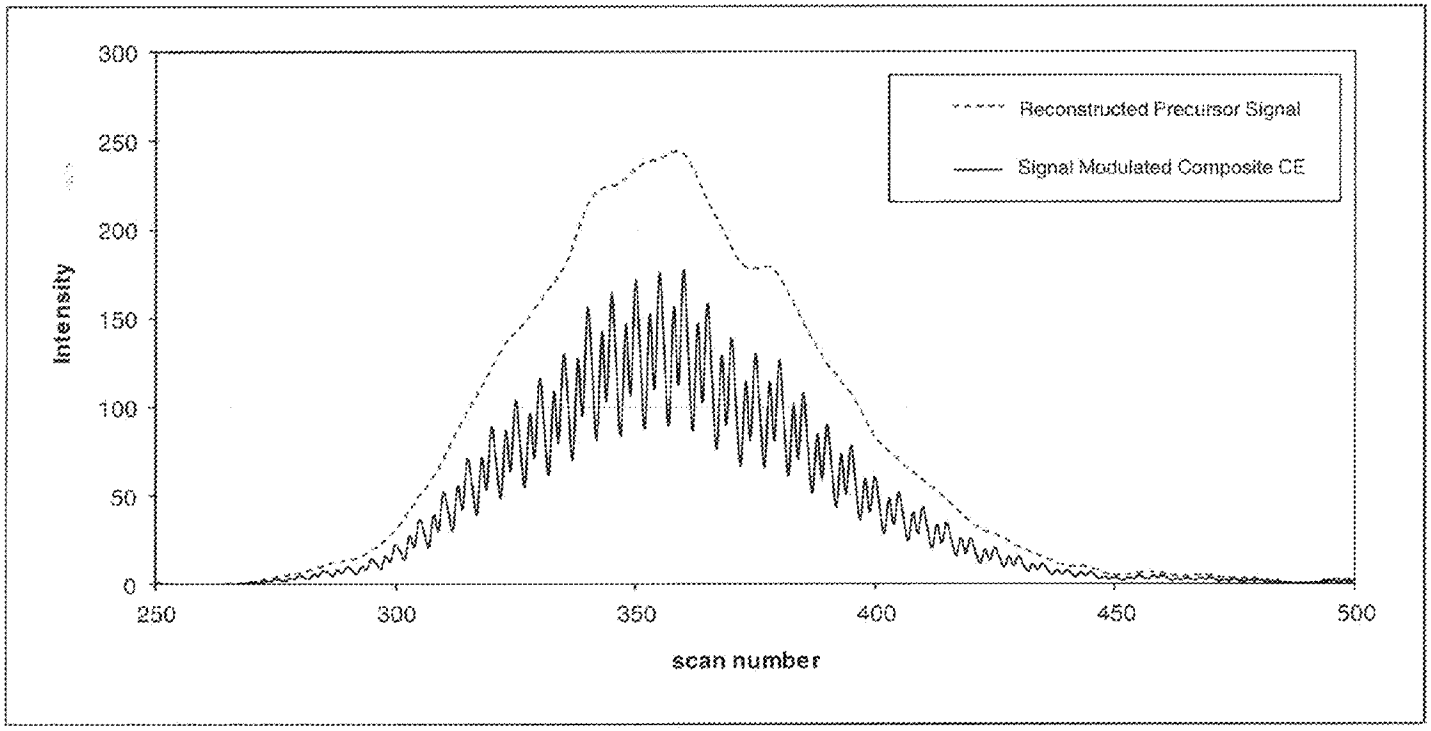
FIG. 3 shows the same pattern repeated over the LC elution profile according to various embodiments of the applicant's teachings.

FIG. 3, shows the same pattern repeated over the LC elution profile. Here we display the signal obtained from the original recorded data (composite spectra—solid line) as well as the reconstructed data for the precursor signal (dotted line).

Figure 4A:
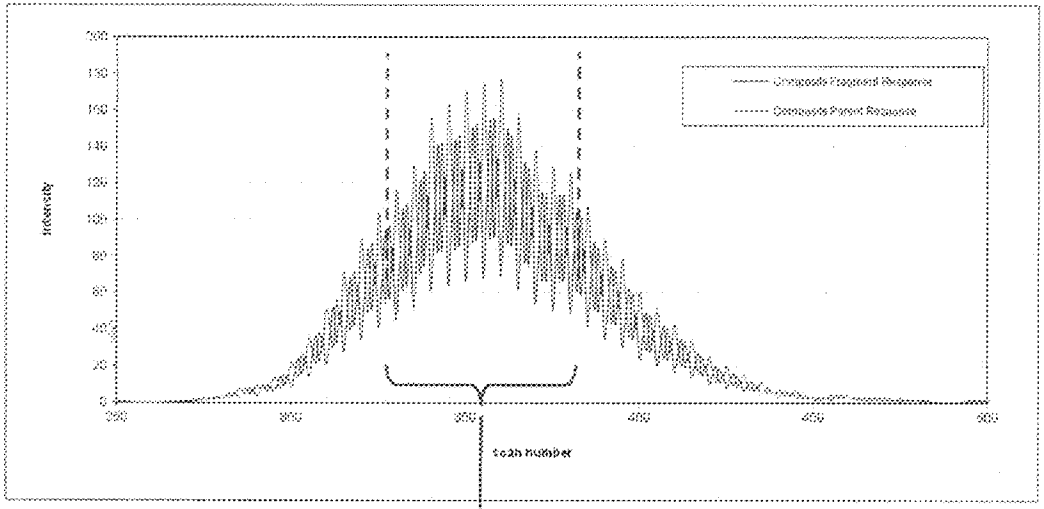
FIG. 4 shows the same pattern of composite spectrum recorded, but the intensity of the precursor ions (red line) and that of the product ions (blue line) are displayed over the entire LC elution profile (4-A) as well as a portion of the LC elution time (4-B) according to various embodiments of the applicant's teachings.
Figure 4B:
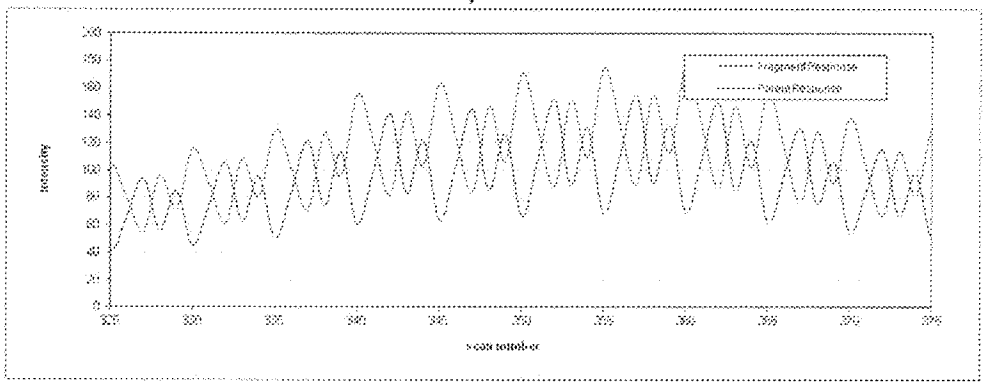

FIG. 4 shows the same pattern of composite spectrum recorded, but here the intensity of the precursor ions (red line) and that of the product ions (blue line) are displayed over the entire LC elution profile (4-A) as well as a portion of the LC elution time (4-B). As displayed in 4-B, the response of the precursor ion and its associated fragment are anti-correlated over time. This anti-correlated signal can be traced back to the modulation applied to generate the composite spectra.

In various embodiments, the related product ions and later generation product ions can be anti-correlated. In various aspects, the modulation comprises varying the collision energy across a range of values.

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, described techniques, or the like, this application controls.

While the applicants' teachings have been particularly shown and described with reference to specific illustrative embodiments, it should be understood that various changes in form and detail may be made without departing from the spirit and scope of the teachings. Therefore, all embodiments that come within the scope and spirit of the teachings, and equivalents thereto, are claimed. The descriptions and diagrams of the methods of the applicants' teachings should not be read as limited to the described order of elements unless stated to that effect.

While the applicants' teachings have been described in conjunction with various embodiments and examples, it is not intended that the applicants' teachings be limited to such embodiments or examples. On the contrary, the applicants' teachings encompass various alternatives, modifications, and equivalents, as will be appreciated by those of skill in the art, and all such modifications or variations are believed to be within the sphere and scope of the invention.

The invention claimed is:

1. A method of mass spectrometry, the method comprising:
generating precursor ions from a sample;
transmitting the precursor ions into a collision cell;
generating product ions in the collision cell;
detecting the precursor and product ions;
applying modulation to vary the number of precursor ions, wherein the modulation applied comprises varying a parameter upstream of the collision cell such that the precursor ion intensity varies in a compound dependent manner; and
identifying precursor ion and product ion relationships by analyzing intensity profiles defined by the modulation.

2. The method of claim 1 wherein related precursor and product ions are determined by identifying ions that are correlated.

3. The method claim 2 wherein the parameter comprises declustering potential.

4. The method of claim 2 wherein the parameter comprises a voltage applied to a differential ion mobility cell.

5. The method of claim 2 wherein the voltage comprises one or more of a compensation voltage and a separation voltage.

6. The method of claim 1 wherein the related precursor and product ions are determined by identifying ions that are anti-correlated.

7. The method of claim 6 wherein the modulation comprises varying the collision energy according to a specified pattern repeated over a continuous series of acquisition cycles.

8. The method of claim 6 wherein the modulation comprises varying the absolute collision energy (CE) values with an equal amount of time spent at each discrete CE value.

9. The method of claim 1 wherein the related product ions and later generation product ions are anti-correlated.

10. The method of claim 9 wherein the modulation comprises varying the collision energy across a range of values.

* * * * *